US007704557B2

(12) United States Patent
Dees

(10) Patent No.: US 7,704,557 B2
(45) **Date of Patent: *Apr. 27, 2010**

(54) COATING COMPOSITION AND METHODS OF COATING

(75) Inventor: Robert J. Dees, Vista, CA (US)

(73) Assignee: Allfast Fastening Systems, Inc., City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/144,365

(22) Filed: Jun. 23, 2008

(65) Prior Publication Data

US 2008/0254221 A1 Oct. 16, 2008

Related U.S. Application Data

(63) Continuation of application No. 11/150,339, filed on Jun. 10, 2005, now Pat. No. 7,413,777.

(60) Provisional application No. 60/579,046, filed on Jun. 12, 2004.

(51) Int. Cl.
*B05D 3/00* (2006.01)
*B05D 1/18* (2006.01)

(52) U.S. Cl. ..... 427/327; 427/435; 427/430.1; 427/307; 427/299

(58) Field of Classification Search ..... 427/430.1, 427/435, 327, 307
See application file for complete search history.

(56) References Cited

U.S. PATENT DOCUMENTS

| | | | | |
|---|---|---|---|---|
| 2,236,549 | A | 4/1941 | Darsey et al. | |
| 2,989,427 | A * | 6/1961 | Noonan et al. | 428/470 |
| 3,982,951 | A * | 9/1976 | Palagos | 106/14.21 |
| 5,492,766 | A * | 2/1996 | Howard et al. | 428/469 |
| 6,733,837 | B1 | 5/2004 | Dees | |
| 7,413,777 | B2 * | 8/2008 | Dees | 427/327 |
| 2006/0272748 | A1 * | 12/2006 | Gentschev et al. | 148/270 |

FOREIGN PATENT DOCUMENTS

| | | |
|---|---|---|
| DE | 1446362 | 3/1969 |
| DE | 2830468 | 1/1979 |
| DE | 242061 | 1/1987 |
| WO | WO-0171060 | 9/2001 |

OTHER PUBLICATIONS

"Chromate Conversion Coating," U.S. Specialty Color Corporation, http://webarchive.org/web/20021014043121/usspcialty.com/product/prod_chem.htm, Oct. 14, 2002.*

(Continued)

*Primary Examiner*—David Turocy
(74) *Attorney, Agent, or Firm*—Blakely Sokoloff Taylor & Zafman LLP

(57) ABSTRACT

Various coatings and methods of coating fasteners are disclosed. In one embodiment, a method of coating includes applying a chromate coating to a fastener. In other embodiments, the method may include deoxidizing an aluminum fastener, etching the fastener, deoxidizing the fastener a second time, applying a chromate coating to the fastener, and dying the fastener.

8 Claims, 2 Drawing Sheets

OTHER PUBLICATIONS

Marzano, Michael, "Dyeing Conversion Coatings", PF Online, www.pfonline.com/articles/article_print1.cfm, 2000 Products Finishing Directory. 3 pages.*

Search results for "dyeing conversion" on www.Pfonline.com articles. pp. 1 of 1.*

Search results for "dyeing conversion" on www.Pfonline.com articles, (Aug. 6, 2007), p. 1 of 1.

Allfast Fastening Systems, Inc., "PCT Search Report and Written Opinion of the International Searching Authority" mailed Jun. 13, 2007, PCT/US2005/021280.

"Rivet Rash—The Itch That Won't Heal", Boeing Environmental Technotes, vol. 8, No. 3, (Aug. 2003), 4 pages.

Marzano, M, "Dyeing conversion coatings", PF Online, www.pfonline.com/articles/article_print1.cfm, 2000 Products Finishing Directory, 3 pages.

U.S. Specialty Color Corporation, "Chromate Conversion Coating", http://webarchive.org/web/20021014043121/usspecialty.com/product/prod_chem.htm, (Aug. 6, 2007), 3 pages.

* cited by examiner

COATING COMPOSITION AND METHODS OF COATING

CROSS-REFERENCE TO RELATED APPLICATION

This application is a continuation of U.S. patent application Ser. No. 11/150,339, filed Jun. 10, 2005 (now U.S. Pat. No. 7,413,377), which claims the benefit of the earlier filing date of U.S. Provisional Patent Application No. 60/579,046, filed Jun. 12, 2004, and incorporated herein by reference.

FIELD

The embodiments disclosed herein relate generally to coatings.

BACKGROUND

There are many applications in which fasteners are used to join various parts of a device, machine, or vehicle together during the manufacturing process. One field where this is particularly important is the aircraft or airline industry. For example, fasteners may be used to mechanically join the outer skin of an aircraft to the subassembly. In some instances, the fasteners may be made of an aluminum alloy (e.g., 2017 or 2117). The exterior of most aircraft are made primarily of metal material, particularly aluminum and titanium.

A popular fastener to join most panels (e.g., metal panels) that make up, for example, the body of an aircraft are rivets. The exposed surface of such fasteners must meet corrosion resistance standards mandated by aircraft manufacturers.

Aluminum alloy fasteners may be treated (e.g., solution heat-treated, aged, coated, etc.) to attain certain physical and/or mechanical properties. For example, some aluminum alloy fasteners may be coated with an Alodyne coating to protect the base metal against corrosion damage.

The physical and mechanical properties of various aluminum alloys (e.g., 2017 and 2117) may be different. Thus, fasteners (e.g., rivets) made from these various materials will likewise be different. For example, a 2117 rivet is approximately 25 percent softer than a 2017 rivet. The method used to distinguish, for example, a 2117 rivet from a 2017 rivet is to place an indented dimple on the head of the 2117 fastener. Despite the use of this identification technique, cases in aircraft manufacturing have been documented where the softer 2117 fastener has been installed where the harder 2017 fastener should have been installed. Once this mistake is discovered a costly replacement program must be undertaken to drill out the softer 2117 alloy and replace it with the correct stronger 2017 alloy. If the mistake goes undiscovered, the damages could add up to the millions of dollars or the worst case situation, in human casualties. One solution proposed by aircraft manufacturers to this identification problem is to color code rivets for a specific user. For example, one aircraft manufacturer mandates that a 2117 rivet used to mechanically join the outer skin of an aircraft to the wing attachment subassembly be dyed orange. Unfortunately, it is often difficult to maintain the corrosion resistance properties of a dyed rivet, particularly in the case of a 2117 orange dyed rivet.

It is also difficult to achieve acceptable paint adhesion of subsequently applied paint to a dyed rivet. To target rivets having perceived acceptable corrosion resistance and/or paint adhesion, standards on the shade of the dye on the rivet have been implemented. Unfortunately, with conventional dye materials and procedures, these standards have proved difficult to meet.

DESCRIPTION OF THE DRAWINGS

Various embodiments are illustrated by way of example and not by way of limitation in the figures of the accompanying drawings in which like references indicate similar elements. It should be noted that references to "an," "one," "the," "other," "another," "alternative," or "various" embodiments in this disclosure are not necessarily to the same embodiment, and such references mean at least one.

DETAILED DESCRIPTION

Figure 1:
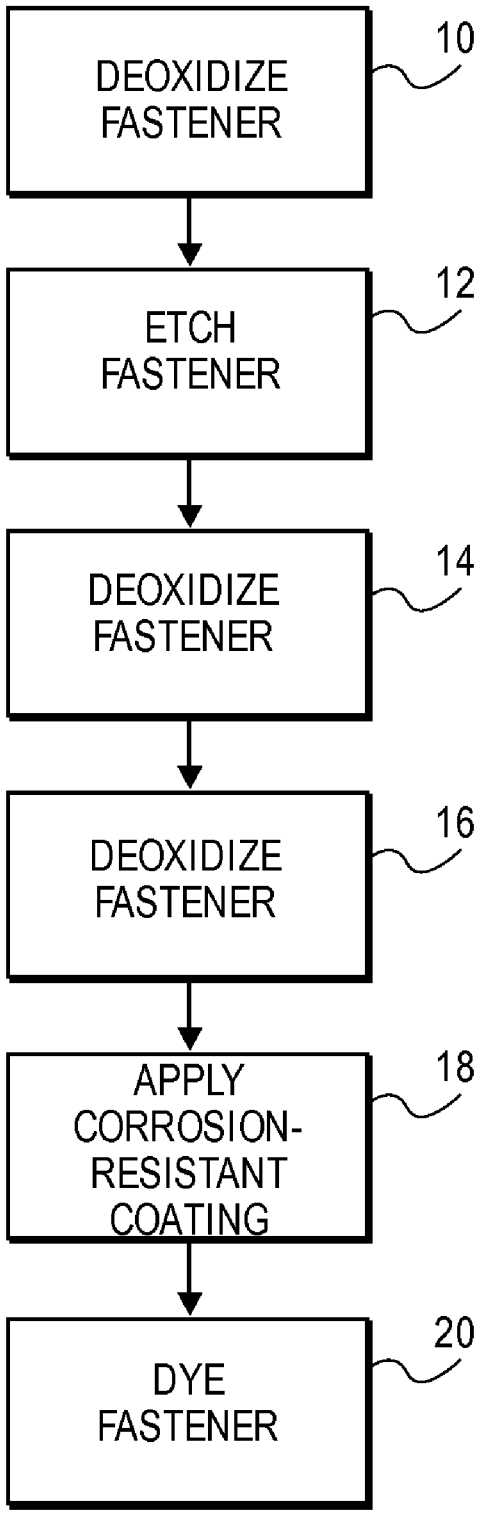
FIG. 1 is a flow chart showing one embodiment of a method of coating a fastener.

Referring now to FIG. 1, a method of coating a metal surface is described. The method is described with respect to coating a metal fastener, such as an aluminum or titanium rivet or rivets. It is appreciated that the technique described may be applicable to coating other substrates particularly other metal substrates. Suitable metal fasteners include, but are not limited to clips, staples, screws, and bolts.

Referring to FIG. 1, it is appreciated that metals such as aluminum and titanium tend to oxidize in the presence of oxygen, such as atmospheric oxygen. In block 10 the metal surface, particularly metal surfaces that are to be exposed such as heads of fasteners or rivets (e.g., a 2117 T-4 aluminum fastener), are deoxidized by chemical or physical (e.g., sputtering) means to remove an oxide coating or layer from the surface of the metal.

In one embodiment, for example, the deoxidation may include deoxidizing the fastener in a solution of between approximately 12 percent to 15 percent nitric acid ($HNO_3$) for a period of approximately 30 seconds, followed by a rinse (e.g., a water rinse). Other deoxidizing agents, concentrations, and process times besides those recited here may be used.

At block 12, the fastener is etched with an etching solution. In one embodiment, the etching solution may contain, for example, an alkaline etchant such as DURAETCH™ commercially available from DURACHEM of Lake Elsinore, Calif. In one embodiment, a fastener such as a rivet is exposed to a concentration level of DURAETCH™ at approximately 8.5 ounces per gallon for approximately 15 seconds at approximately 150° F., followed by an aqueous (e.g., double water) rinse. Other etchants, concentrations, and process times and temperatures may be used beyond the specific examples stated above.

In one embodiment, the fastener is exposed to a second deoxidization treatment, at block 14, in a manner similar to that set forth above for the deoxidation at block 10. The deoxidation at block 14 may advantageously prepare the surface of the fastener to receive a corrosion inhibiting or resisting coating and increase adhesion of the dye, to be applied at a later time. The fastener may then be rinsed in, for example, a double water rinse (e.g., rinsing the fastener twice in successive containers of water).

At block 16, in one embodiment, the fastener is exposed to a third deoxidization treatment similar to that set forth above for the deoxidation at block 10. Without wishing to be bound by a particular result or objective of the multiple deoxidation treatments or the requirement for multiple deoxidation treatments, the first and second deoxidation treatments tend to remove smut from the fastener while the third deoxidation treatment prepares the clean surface for subsequent processing.

At block 18, a corrosion inhibiting or resistive coating is applied to the fastener. In one embodiment, the corrosion resistive or inhibiting coating is a chromatic coating, representatively, such as ALCHROME2™, commercially available from Heatbath Corporation of Indian Orchard, Mass. ALCHROME 2™ includes chromic acid, potassium ferricyanide, sodium nitrate, and sodium silicofluoride. The chromate coating is applied by placing the fastener in a bath containing between approximately 1.5 and 1.75 ounces of chromate per gallon at a temperature between approximately 70° F. and 80° F. for a period between approximately 80 and 100 seconds. Although specific parameters are disclosed, other coatings, concentrations, and process temperatures and durations may be used.

The fastener is dyed at block 20. For example, in one embodiment for color coating a 2117 rivet for aircraft uses, an orange dye such as ORANGE7™ commercially available from U.S. Specialty Color Corporation of Monroe, N.C. is suitable. A 2117 rivet may be placed in a dye tank containing approximately three grams of ORANGE7™ orange dye per liter at a pH between approximately 4.0 and 4.2 at a temperature between approximately 90° F. and 100° F. for a period between approximately one to two minutes.

Figure 2:
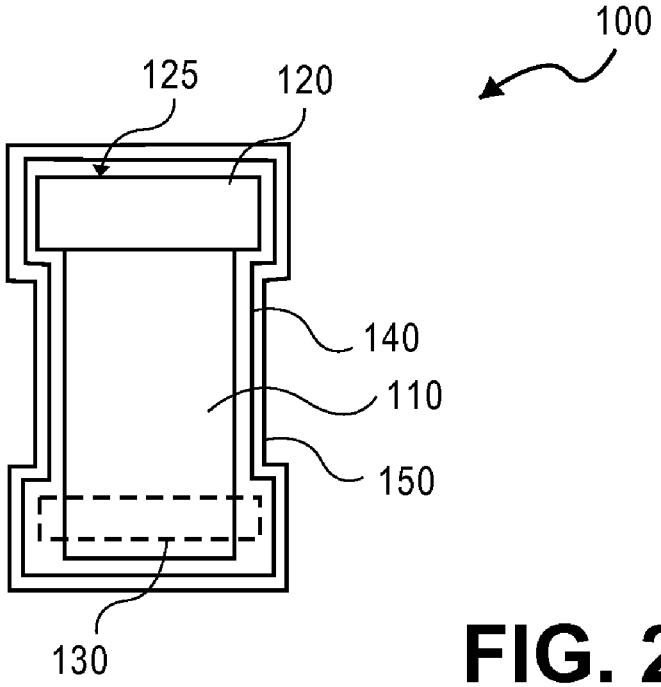
FIG. 2 shows a schematic side view of a fastener having the exposed surfaces thereof coated with a chemical film and a dye.

FIG. 2 shows a schematic side view of a fastener. Fastener 100 is, for example, a rivet suitable for use in fastening metal component panels of aircraft or other vehicles. In this embodiment, fastener 100 is a metal material, such as aluminum or titanium. Fastener 100 includes shank 110, head 120, including surface 125, and upset head 130. In the embodiment where fastener 100 is a rivet, in one embodiment, shank 110, head 120, and upset head 130 are a unitary body of aluminum material. Suitable grades of aluminum for a rivet in the aircraft or airline industry include, but are not limited to, 2017, 2117 and 7050 aluminum. Representative diameters, in inches, for rivets for use in the aircraft industry to fasten panels range from 3/32 to 8/32 and larger, depending on the particular fastening or other application.

Referring to FIG. 2, prior to any coating, fastener 100 may have been exposed to one or more deoxidation and etching treatments as noted above with respect to FIG. 1 and the accompanying text. Fastener 100 includes first layer 140, in this embodiment, directly disposed on or in direct contact with exterior and/or exposed surfaces of fastener 100. For an aluminum material of fastener 100, first layer 140 is a chemical conversion coating. A suitable chemical conversion coating includes, but is not limited to ALCHROME 2™. A suitable thickness of first layer 140 of ALCHROME 2™ on a fastener that is an aluminum rivet is, for example, on the order of less than one mil to pass the MIL-C-5541 class 1A salt spray standard for a fastener (e.g., 48 hour salt spray exposure). One suitable conversion coating for a titanium material is a phospho-fluoride coating.

Overlying first layer 140 of fastener 100 in FIG. 2 is second layer 150. In one embodiment, second layer 150 is a dye such as an orange dye (e.g., ORANGE7™). Second layer 150 of ORANGE7™ orange dye was applied to fastener 100, in one embodiment, by placing fastener 100 in a bath containing approximately three grams of Orange7™ per liter at a pH of approximately 4.0 to 4.2 and a temperature between 90° F. and 100° F. Fastener 100 was placed in the bath for approximately one to two minutes. A resulting aluminum fastener has a dull orange appearance. Without wishing to be bound by theory, it is believed the dye exists on fastener 100 at least partially as a layer as indicated by second layer 150. The dye process may, however, modify first layer 140 and therefore no or a minimal second layer will be determinable.

Figure 3:
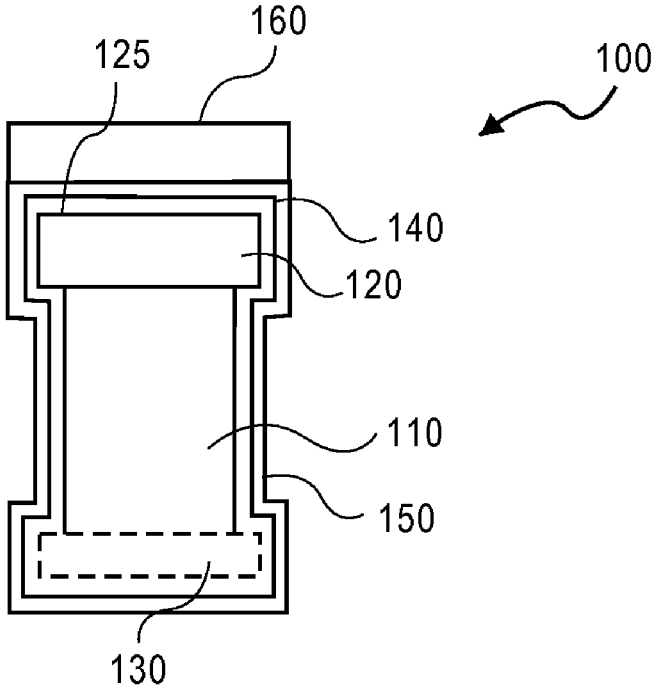
FIG. 3 shows the rivet of FIG. 2 having a paint coating applied to one surface of the fastener.

FIG. 3 shows fastener 100 of FIG. 2 following the introduction of coating 160, such as a paint. Coating 160, as a paint, includes an epoxy-based paint system, a polyurethane-based system, or a polyimide-based system. In FIG. 3, only head 120 of fastener 100 (e.g., surface 125 of head 120) includes coating 160 as might be expected if coating 160 was applied after fastener 100 was placed (e.g., to fasten an aircraft panel).

To demonstrate the effectiveness of the dye coated fasteners described above, an experiment was conducted using orange dye on 2117 grade aluminum rivet fastened to panels (aluminum panels). The orange dye, specifically, ORANGE7™, was purchased from U.S. Specialty Color Corporation of Monroe, N.C. The recommended process cycle by U.S. Specialty Color Corporation for orange dye—chromate coating is:

Etch 8 oz/gal, one minute, 140° F.

Deox 15% by volume, two minutes, ambient temperature.

Chromate 2 oz/gal, three minutes, ambient.

Orange dye 4 grams/liter (pH 4.0), 10 minutes, ambient temperature.

The following experiment compared similar orange dye both freshly prepared (Test 1) and aged two months (Test 2). The following parameters were used in the experiment:

Test 1

Alchrome2 (conversion coating)→concentration=1.75 oz/gal, temperature=79° F. Time=90 seconds.

Double rinse→D.I. water, time=30 seconds (1 minute total), Temperature=79° F.

Orange dye→concentration=3 grams/liter, pH=4.0, temperature=100° F. Time=1 minute, 2 minute and 3 minutes.

Final rinse→D.I. water, Time=30 seconds, Temperature=95° F.-100° F.

Centrifuge dry 5 minutes.

Test 2

Alchrome2 (conversion coating)→concentration=1.75 oz/gal temperature=79° F. Time=90 seconds.

Double rinse→D.I. water, Time=30 seconds (1 minute total), Temperature=79° F.

Orange dye→concentration=4 grams/liter, pH=4.0, temperature=100° F. Time=1 minute, 2 minute and 3 minutes.

Final rinse→D.I. water, Time=30 seconds, Temperature=95° F.-100° F.

Centrifuge dry 5 minutes.

The rivets treated as described above were fastened to aluminum panels. The panels were primed with one coat of a primer and cured for one week. The primed rivets were scribed with a single line. For a wet adhesion test, a panel including primed and scribed rivets was placed in distilled water for seven days to simulate long term environmental exposure. In a dry adhesion test, adhesive tape strips were applied 10 to 20 times to the head of each rivet of a panel with pressure. The same process was performed on the panel that had been previously submerged in the water bath for a wet adhesion test. The amount of paint removal was determined by visual analysis and compared to a control having the conversion coating and the primer.

The following table summarizes the results of the experiment. The results indicate that rivets submerged in an orange dye for only one to two minutes had better paint adhesion than rivets submerged for three minutes. The results were consistent with both fresh and aged dye.

| Panel# | Age of Dye Bath | Dye Conc. (g/l) | Dye Time (min) | Dry Adhesion (% Paint Loss) | | | Average | Wet Adhesion (% Paint Loss) | | | Average |
|---|---|---|---|---|---|---|---|---|---|---|---|
| 1 | Fresh | 3 | 1 | 0 | 0 | 0 | | 0 | 0 | 0 | |
| 2 | Fresh | 3 | 1 | 0 | 0 | 0 | 0 | 5 | 0 | 0 | 1 |
| 3 | Fresh | 3 | 2 | 10 | 20 | 5 | | 5 | 0 | 0 | |
| 4 | Fresh | 3 | 2 | 5 | 5 | 5 | 8 | 20 | 5 | 0 | 5 |
| 5 | Fresh | 3 | 3 | 5 | 5 | 0 | | 5 | 5 | 15 | |
| 6 | Fresh | 3 | 3 | 0 | 0 | 0 | 2 | 15 | 5 | 5 | 8 |
| 7 | Aged | 4 | 1 | 0 | 0 | 0 | | 0 | 0 | 0 | |
| 8 | Aged | 4 | 1 | 0 | 0 | 0 | 0 | 5 | 5 | 10 | 3 |
| 9 | Aged | 4 | 2 | 15 | 20 | 15 | | 45 | 15 | 10 | |
| 10 | Aged | 4 | 2 | 10 | 10 | 10 | 13 | 30 | 5 | 20 | 21 |
| 11 | Aged | 4 | 3 | 30 | 5 | 5 | | 45 | 40 | 35 | |
| 12 | Aged | 4 | 3 | 30 | 15 | 5 | 15 | 40 | 30 | 10 | 33 |
| 13 | "Leached" Controls | | | 0 | 0 | 0 | | 0 | 0 | 0 | |
| 14 | "Leached" Controls | | | 0 | 0 | 0 | 0 | 40 | 40 | 55 | 23 |

It is to be understood that even though numerous characteristics and advantages of various embodiments have been set forth in the foregoing description, together with details of structure and function of the various embodiments, this disclosure is illustrative only. Changes may be made in detail, especially matters of structure and management of parts, without departing from the scope of the various embodiments as expressed by the broad general meaning of the terms of the appended claims.

What is claimed is:

1. A method comprising:

preparing a rivet comprising an aluminum alloy by subjecting the rivet to deoxidizing and etching operations, wherein a deoxidizing operation precedes and follows an etching operation;

applying a chromate coating to the prepared rivet; and after applying the chromate coating, dying the rivet by placing the rivet in an environment comprising 3 grams of dye per liter at a pH between 4 and 4.2 at a temperature between 90° F. and 100° F. for a period between 1.5 and two minutes.

2. The method of claim 1, wherein applying comprises:

placing the rivet in a bath containing between approximately 1.5 and 1.75 ounces of chromate per gallon at a temperature between 70° F. and 80° F. for a period between 80 and 100 seconds.

3. The method of claim 1, wherein the rivet comprises a 2117 aluminum alloy.

4. A method comprising:

deoxidizing and etching a rivet comprising an aluminum alloy wherein deoxidizing precedes and follows etching;

applying a chromate film to the rivet in compliance with an aircraft manufacturing industry standard; and after applying the chromate film, dying the rivet by placing the rivet in an environment comprising 3 grams of dye per liter at a pH between 4 and 4.2 at a temperature between 90° F. and 100° F. for a period between 1.5 and two minutes.

5. The method of claim 4, wherein dying comprises dying the rivet an orange color.

6. A method comprising:

preparing a rivet comprising an aluminum alloy by subjecting the rivet to deoxidizing and etching operations, wherein a deoxidizing operation precedes and follows an etching operation;

applying a chromate coating to the prepared rivet; and after applying the chromate coating, dying the rivet by placing the rivet in an environment comprising 3 grams of orange dye per liter at a pH between 4 and 4.2 at a temperature between 90° F. and 100° F. for a period between 1.5 and two minutes.

7. The method of claim 6, wherein applying comprises:

placing the rivet in a bath containing between approximately 1.5 and 1.75 ounces of chromate per gallon at a temperature between 70° F. and 80° F. for a period between 80 and 100 seconds.

8. The method of claim 7, wherein the rivet comprises a 2117 aluminum alloy.

* * * * *